US010185260B2

(12) United States Patent
Mukoyama et al.

(10) Patent No.: US 10,185,260 B2
(45) Date of Patent: Jan. 22, 2019

(54) FIXING BELT, FIXING DEVICE, AND IMAGE FORMING APPARATUS

(71) Applicant: Konica Minolta, Inc., Tokyo (JP)

(72) Inventors: Izumi Mukoyama, Hachioji (JP); Hirofumi Koga, Hino (JP); Naoko Uemura, Hachioji (JP); Asao Matsushima, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/698,815

(22) Filed: Sep. 8, 2017

(65) Prior Publication Data

US 2018/0088500 A1 Mar. 29, 2018

(30) Foreign Application Priority Data

Sep. 27, 2016 (JP) ..... 2016-188645

(51) Int. Cl.
*G03G 15/20* (2006.01)

(52) U.S. Cl.
CPC ..... *G03G 15/2053* (2013.01); *G03G 15/2057* (2013.01); *G03G 15/2064* (2013.01)

(58) Field of Classification Search
CPC ..... G03G 15/2053; G03G 15/2057; G03G 15/206
See application file for complete search history.

(56) References Cited

U.S. PATENT DOCUMENTS

| | | | | |
|---|---|---|---|---|
| 9,501,013 | B2 * | 11/2016 | Lee | G03G 15/2057 |
| 9,696,671 | B1 * | 7/2017 | Massie | G03G 15/2057 |
| 2002/0125237 | A1 * | 9/2002 | Ohno | G03G 15/2064 219/216 |
| 2008/0286018 | A1 * | 11/2008 | Lee | G03G 15/2053 399/329 |
| 2009/0290918 | A1 * | 11/2009 | Eichhorn | G03G 15/206 399/333 |
| 2013/0251426 | A1 * | 9/2013 | Omata | G03G 15/2057 399/333 |
| 2016/0320730 | A1 * | 11/2016 | Uehashi | G03G 15/2053 |

FOREIGN PATENT DOCUMENTS

JP 2001215821 A 8/2001

* cited by examiner

*Primary Examiner* — Walter L Lindsay, Jr.
*Assistant Examiner* — Arlene Heredia
(74) *Attorney, Agent, or Firm* — Lucas & Mercanti, LLP

(57) ABSTRACT

A fixing belt includes: a base layer having heat resistance; an elastic layer disposed on the base layer and made of an elastic material; and a releasing layer disposed on the elastic layer, wherein a storage elastic modulus of the base layer is 3.8 to 4.8 GPa.

10 Claims, 3 Drawing Sheets

FIXING BELT, FIXING DEVICE, AND IMAGE FORMING APPARATUS

Japanese Patent Application No. 2016-188645 filed on Sep. 27, 2016, including description, claims, drawings, and abstract the entire disclosure is incorporated herein by reference in its entirety.

BACKGROUND

Technological Field

The present invention relates to a fixing belt, a fixing device, and an image forming apparatus.

Description of the Related Art

A fixing device used in an image forming apparatus such as a copying machine or a laser beam printer generally brings a heated fixing belt into contact with a recording medium carrying an unfixed toner image so that the toner image is fixed onto the recording medium. In the fixing device, for example, one of two or more rollers supporting an endless fixing belt is a heating roller heating the fixing belt. Since the thermal capacity of the fixing belt is relatively small, the fixing device has an excellent fixing property and has an advantage in, for example, high-speed image formation.

As the fixing belt, there is known an endless fixing belt which includes a base layer made of polyimide and containing filler and other layers such as a heat-resistant elastic layer or releasing layer formed thereon, wherein a tensile elastic modulus is 5000 N/mm$^2$ or more (for example, see JP 2001-215821 A). Since the fixing belt has high dispersibility of the filler in the base layer, the fixing belt is excellent in surface smoothness and thickness uniformity and is also excellent in mechanical strength and durability. Accordingly, even when the elastic layer or the releasing layer is further laminated thereon, it is possible to transport a recording medium for a long period of time while realizing a good fixing property.

Meanwhile, there is a demand for high-speed image formation in the above-described image forming apparatus. In the high-speed image formation, the fixing operation needs to be performed at a high speed. In general, the toner image is fixed by heating and pressing the toner image at a fixing nip portion. In the fast fixing, not only high-speed fixing but also an excellent separation property between the fixing belt and the recording medium on which the toner image is fixed is required. In order to satisfactorily separate the recording medium at the time of fixing, a releasing layer having excellent releasability is disposed on the surface layer of the fixing belt to solve a problem caused by the material of the fixing belt. However, this solution is not sufficient for the high-speed image formation in some cases.

SUMMARY

An object of the present invention is to provide a technology for a fixing operation capable of excellently fixing a toner image and separating a recording medium at the time of fixing the toner image in electrophotographic image formation.

To achieve the abovementioned object, according to an aspect of the present invention, a fixing belt reflecting one aspect of the present invention comprises: a base layer having heat resistance; an elastic layer disposed on the base layer and made of an elastic material; and a releasing layer disposed on the elastic layer, wherein a storage elastic modulus of the base layer is 3.8 to 4.8 GPa.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
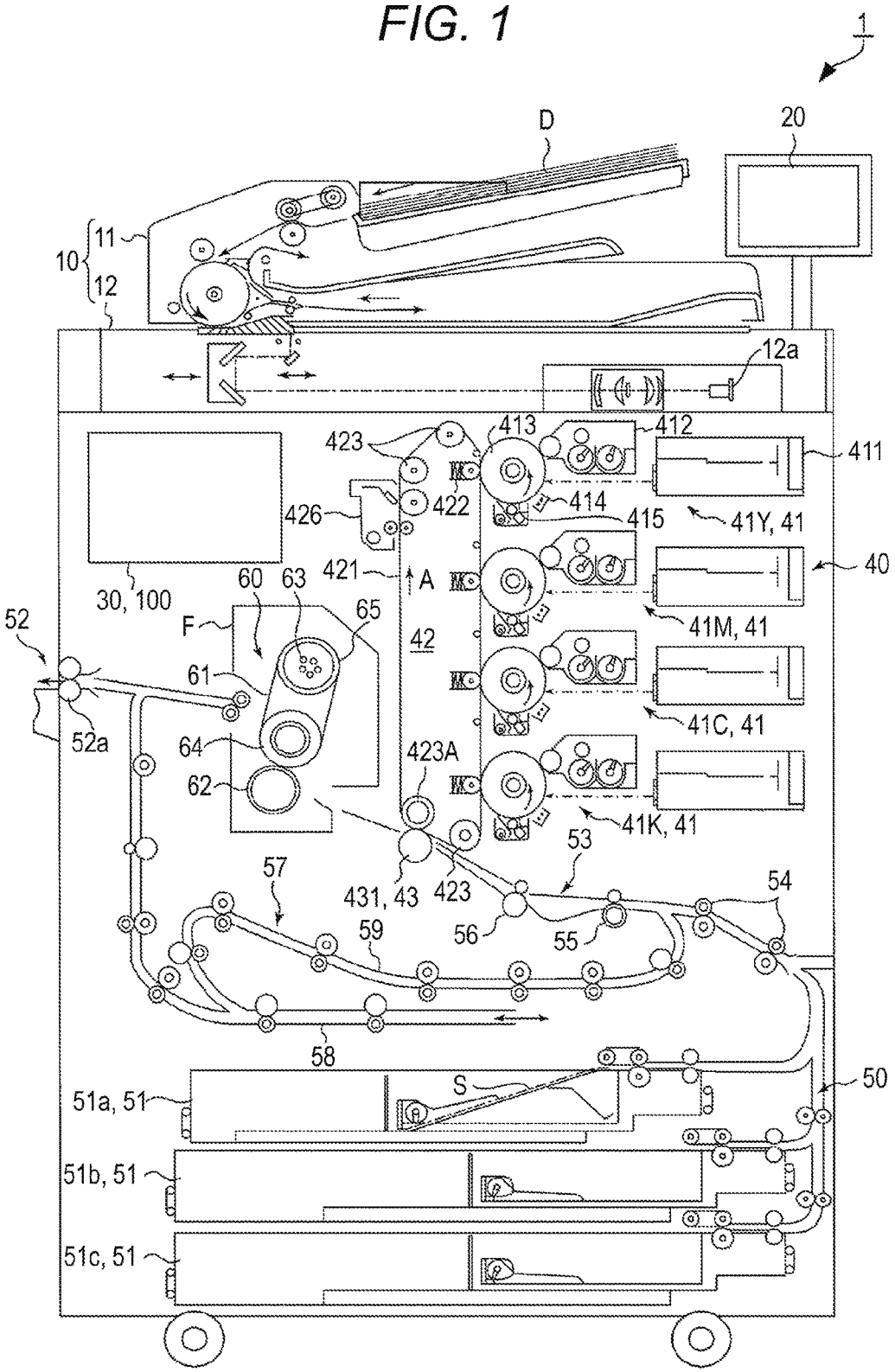
FIG. 1 is a diagram schematically illustrating a configuration of an image forming apparatus according to an embodiment of the present invention.

Hereinafter, one or more embodiments of the present invention will be described with reference to the drawings. However, the scope of the invention is not limited to the disclosed embodiments. A fixing belt according to an embodiment of the present invention includes a base layer having heat resistance, an elastic layer made of an elastic material and disposed on the base layer, and a releasing layer disposed on the elastic layer. The fixing belt can have the same configuration as that of a known fixing belt in which a base layer, an elastic layer, and a releasing layer overlap in this order except that the base layer has a storage elastic modulus as will be described later.

For example, the elastic layer is a layer having elasticity which contributes to improvement in contact property at a fixing nip portion between a surface of the fixing belt and a recording medium which carries an unfixed toner image and can be, for example, a layer made of an elastic material of which a loss tan δ (a ratio of a loss elastic modulus with respect to a storage elastic modulus) at 20 Hz is 0.1 or less. Examples of such an elastic material include an elastic resin material which includes silicone rubber, thermoplastic elastomer, and a rubber material. Among them, it is preferable that the elastic material be silicone rubber from the viewpoint of heat resistance in addition to desired elasticity.

The silicone rubber may be of one kind or more. Examples of the silicone rubber include polyorganosiloxane or a heat-cured product thereof and an addition reaction type silicone rubber described in JP 2009-122317 A. Examples of the polyorganosiloxane include dimethylpolysiloxane which is capped at both ends with a trimethylsiloxane group and has a vinyl group at a side chain as described in JP 2008-255283 A.

The thickness of the elastic layer is preferably from 5 to 300 μm, more preferably from 50 to 250 μm, and still more preferably from 100 to 200 μm from the viewpoint of sufficiently exhibiting heat conductivity and elasticity.

The elastic layer may further include components other than the elastic resin material as long as the effect of the embodiment can be obtained. For example, the elastic material may further include a thermally conductive filler for enhancing the heat conductivity of the elastic layer. Examples of the material of the filler include silica, metallic silica, alumina, zinc, aluminum nitride, boron nitride, silicone nitride, silicone carbide, carbon, and graphite. The form of the filler is not limited and may be, for example, a spherical powder, an amorphous powder, a flat powder, or a fiber.

The content of the elastic resin material in the elastic material is preferably, for example, 60 to 100 vol %, more preferably 75 to 100 vol %, and still more preferably 80 to 100 vol % from the viewpoint of achieving both heat conductivity and elasticity.

Further, for example, the releasing layer is a layer having releasability which contributes to improvement in the separation property of a melted toner layer on the recording medium from the surface of the fixing belt at the fixing nip portion and has appropriate releasability to the toner component. The releasing layer constitutes an outer surface of the fixing belt that comes into contact with the recording medium at the time of fixing.

Examples of the material of the releasing layer include polyethylene, polypropylene, polystyrene, polyisobutylene, polyester, polyurethane, polyamide, polyimide, polyamideimide, alcohol soluble nylon, polycarbonate, polyarylate, phenol, polyoxymethylene, polyetheretherketone, polyphosphazene, polysulfone, polyether sulfide, polyphenylene oxide, polyphenylene ether, polyparabanic acid, polyallylphenol, fluororesin, polyurea, ionomer, silicone, and mixtures or copolymers thereof. From the viewpoint of the releasability and the heat resistance, the material of the releasing layer is preferably a fluororesin and more preferably a perfluoroalkoxy fluororesin (PFA).

The thickness of the releasing layer is preferably from 5 to 40 μm, more preferably from 10 to 35 μm, and still more preferably from 20 to 30 μm from the viewpoint of, for example, transferring heat, following the deformation of the elastic layer, and exhibiting releasability.

The releasing layer may further include components other than the above-described resin material as long as the effect of the embodiment can be obtained. For example, the releasing layer may further include lubricant particles. Examples of the lubricant particles include fluororesin particles, silicone resin particles, and silica particles.

The content of the resin material in the material of the releasing layer is preferably 70 to 100 vol % from the viewpoint of heat conductivity and flexibility sufficiently following the deformation of the elastic layer.

The base layer has storage elastic modulus of 3.8 to 4.8 GPa. Since the base layer in the fixing belt having the (three layer) lamination structure has the above-described storage elastic modulus, both good fixation of the toner image and good separation of the recording medium are realized even in the case of the high-speed image formation in the electrophotographic system. When the storage elastic modulus of the base layer is smaller than 3.8 GPa, the separation property of the fixing belt with respect to the recording medium may be insufficient. Meanwhile, when the storage elastic modulus exceeds 4.8 GPa, the fixing property of the fixing belt may be insufficient. From the viewpoint of enhancing both of the separation property and the fixing property, the storage elastic modulus is preferably 4.0 to 4.5 GPa.

The storage elastic modulus of the base layer can be measured by a known measurement method, for example, a dynamic viscoelasticity measurement (DMA) in a tensile mode. The storage elastic modulus of the base layer can be obtained by measuring the base layer itself, but since the mechanical influence of the base layer of the fixing belt is the most dominant compared with other layers, the storage elastic modulus can be obtained from the measurement of the fixing belt itself by performing an appropriate process if necessary. Examples of such an appropriate process include a correction based on a correlation in storage elastic modulus between the fixing belt and the base layer obtained in advance.

The storage elastic modulus of the base layer can be adjusted by various conditions including the physical properties of the main materials forming the base layer and the type and the content of the additive in the base materials in addition to the formulation of the resin, the molding condition of the base layer, the temperature raising condition in molding, and the atmosphere in the case where the material is resin. As an example, the storage elastic modulus of the base layer can be adjusted by containing filler in the material composition of the base layer when the main material of the base layer is resin. In this case, the storage elastic modulus can be increased when the content of the filler is decreased.

From the viewpoint of increasing the durability of the fixing belt, the base layer preferably has a bending strength of 5000 times or more and more preferably 5800 times or more. According to the above-described viewpoint, the higher bending strength is preferable.

The bending strength can be obtained by a known measurement method, for example, a bending endurance-MIT test defined in JIS P 8115: 2001 corresponding to ISO 5626: 1993. The bending strength can also be obtained from the base layer itself as well as the storage elastic modulus and can be obtained from the fixing belt by further applying an appropriate process if necessary.

Similarly to the storage elastic modulus, the bending strength can also be adjusted by various conditions including the physical properties of the main materials forming the base layer and the type and the content of the additive in the base materials in addition to the formulation of the resin, the molding condition of the base layer, the temperature rise condition in molding, and the atmosphere in the case where the material is resin. In the case of the base layer made of resin, the bending strength can be increased if the content of the filler in the material composition of the base layer is decreased.

Further, the base layer preferably has a higher tensile strength from the viewpoint of enhancing the durability. From such a viewpoint, the tensile strength of the base layer is preferably 250 MPa or more and more preferably 290 MPa or more. Similarly to the bending strength, the higher tensile strength is preferable from the viewpoint of the durability. However, the tensile strength is preferably 330 MPa or less, more preferably 320 MPa or less, and still more preferably 310 MPa or less from the viewpoint of realizing other physical properties required for the base layer of the fixing belt.

The tensile strength can be obtained by a known measurement device and a known measurement method capable of measuring the maximum tensile stress applied during the tensile test of the base layer. Similarly to the storage elastic modulus and the bending strength, the tensile strength can be also obtained from the base layer itself and can be obtained from the fixing belt by further performing an appropriate process if necessary.

Similarly to the storage elastic modulus and the bending strength, the tensile strength can be adjusted by various conditions including the physical properties of the main materials forming the base layer and the type and the content of the additive in the base materials in addition to the formulation of the resin, the molding condition of the base layer, the temperature rise condition in molding, and the atmosphere in the case where the material is resin. In the case of the above-described resinous base layer, the tensile strength can be increased generally when the content of the filler in the material composition of the base layer is increased.

The base layer has heat resistance. The "heat resistance" is sufficiently stable at a temperature (for example, 150 to 220° C.) at which the fixing belt is used for fixing a toner image on a recording medium in electrophotographic image formation and means the exhibition of the desired physical properties. The base layer may have the storage elastic modulus and the heat resistance as described above and may be made of such a material having heat resistance. Examples of the material having such heat resistance include resin (heat-resistant resin) having heat resistance.

The above heat-resistant resin is appropriately selected from resins which do not cause substantial denaturation and deformation at the above-described use temperature of the fixing belt and may be one kind or more. Examples of the heat-resistant resin include polyphenylene sulfide, polyarylate, polysulfone, polyether sulfone, polyether imide, polyimide, polyamide imide, and polyether ether ketone. Among them, polyimide is preferable from the viewpoint of heat resistance.

Polyimide can be obtained by dehydration and cyclization (imidization) of polyamic acid which is a precursor thereof in terms of heating at 200° C. or more or a catalyst. The polyamic acid may be produced by dissolving a tetracarboxylic acid dianhydride and a diamine compound in a solvent and causing a polycondensation reaction through mixing and heating or may be a commercially available product. Examples of the diamine compound and the tetracarboxylic acid dianhydride include the compounds described in paragraphs "0123 to 0130" of JP 2013-25120 A.

The heat-resistant resin is a main material forming the base layer and the content may be enough for forming the base layer. For example, the content of the heat-resistant resin of the base layer is preferably 50% by mass or more, more preferably 60 to 75% by mass, and still more preferably 76 to 90% by mass.

The base layer may further include components other than the heat-resistant resin as long as the effect of the embodiment can be obtained. For example, the base layer may further include the above-described filler. The filler is, for example, a component that contributes to the hardness, the heat conductivity, and the conductivity of the base layer. The filler may be one kind or more and examples thereof include carbon black, Ketjen black, nanocarbon, and graphite.

When the content of the filler in the base layer is too large, the toughness of the base layer may be lowered and the fixing property and the separation property of the fixing belt may be lowered. Further, when the content is too small, for example, the desired effect of the filler may be insufficient so that an appropriate conductivity may not be obtained. From this viewpoint, the content of the filler in the base layer is preferably 3% by mass or more, more preferably 4% by mass or more, and still more preferably 5% by mass or more. Further, from the above-described viewpoint, the content of the filler in the base layer is preferably 30% by mass or less, more preferably 20% by mass or less, and still more preferably 10% by mass or less.

The fixing belt can be manufactured according to a fixing belt manufacturing method including a step of preparing an elastic layer on a base layer and a step of preparing a releasing layer on the elastic layer, wherein the base layer has a storage elastic modulus of 3.8 to 4.8 GPa and has heat resistance. The base layer, the elastic layer, and the releasing layer can be manufactured according to a known method capable of manufacturing these layers.

More specifically, the base layer can be manufactured by molding or curing a material composition including the heat-resistant resin or its precursor and the filler. As described above, the storage elastic modulus of the base layer can be adjusted by, for example, the physical property of the heat-resistant resin which is a main material forming the base layer. Alternatively, the storage elastic modulus can be adjusted by the content of the filler in the material composition of the base layer. Alternatively, the storage elastic modulus can be adjusted by various conditions including the type and the content of additives (for example, crosslinking component and curing accelerator) in the synthesis of the heat-resistant resin, the formulation of the heat-resistant resin (kind and composition of the monomer), the molding condition including curing from the precursor to the heat-resistant resin, the temperature raising conditions such as a temperature range and a temperature raising speed in molding, and the molding atmosphere such as oxygen concentration.

The fixing belt is applied to the fixing device of the electrophotographic image forming apparatus. An image forming apparatus including the fixing belt can have the same configuration as that of a known image forming apparatus including a fixing device for fixing an unfixed toner image on a recording medium onto the recording medium by heating and pressing using a fixing belt except that the above-described fixing belt is provided. The above-described fixing belt is preferably used for the image formation at a high speed by the electrophotographic system and the image forming apparatus is preferably used for the image formation at such a high speed (for example, a printing speed of 60 to 80 sheets/min or more in an A4 size recording medium).

The above-described fixing device includes an endless fixing belt, two or more rollers which support the fixing belt in an endless manner, a heating device which heats the fixing belt supported by the roller, and a pressing roller which is disposed to be relatively urged toward one roller among the two rollers. The fixing device may have the same configuration as that of a known so-called two-axis belt type fixing device except that the fixing belt of the embodiment is provided as the endless fixing belt.

The heating device may be built in at least one of the two or more rollers and may include, for example, a heating roller for heating the fixing belt. The heating roller includes, for example, a heat-conductive sleeve which is made of aluminum and a heat source which corresponds to a halogen heater disposed inside the sleeve. An outer peripheral surface of the sleeve may be covered with a layer of fluororesin such as polytetrafluoroethylene (PTFE).

In addition, the heating device may be a heating device which is disposed outside the roller, that is, a heating device which is disposed at the inner peripheral side or the outer peripheral side of an endless track formed by the supported fixing belt toward the endless track and may include both a heating device built in the roller and a heating device disposed outside the roller.

Among the two or more rollers, the roller other than the heating roller may be one or more and can be appropriately formed in response to other desired functions.

The roller diameter of the roller which is urged by the pressing roller with the fixing belt interposed therebetween is 50 mm or more. When the roller diameter is large, the recording medium is not easily separated from the fixing belt at the fixing nip portion during a fixing operation. Thus, there is a tendency that the separation in the high-speed image formation is difficult. It is more preferable that the roller diameter is 60 mm or more from the viewpoint of the high-speed information formation and the improvement in fixing property of the fixing belt with respect to the recording medium during a fixing operation.

The fixing belt is supported while being suspended on the two or more rollers and receiving a predetermined tensile force. When the tensile force is too large, the physical properties contributing to the adhesion of the fixing belt to the recording medium, such as the elasticity of the elastic layer, may be insufficiently exhibited at the fixing nip portion. From the viewpoint of the adhesion, the tensile force is preferably 45 N or less and more preferably 50 N or less. The tensile force may be set to sufficiently keep the shape of the endless track formed when the fixing belt is supported by the rollers and may be, for example, 20 or more. The tensile force can be adjusted by, for example, a distance between the two or more rollers.

Hereinafter, an embodiment of the present invention will be described with reference to the drawings.

As illustrated in FIG. 1, an image forming apparatus 1 includes an image reading unit 10, an operation display unit 20, an image processing unit 30, an image forming unit 40, a sheet conveying unit 50, a fixing unit 60, and a control unit 100.

The control unit 100 is a device which intensively controls the operations of the blocks of the image forming apparatus 1 in corporation with the expanded program and includes, for example, a central processing unit (CPU), a read only memory (ROM), and a random access memory (RAM).

The image reading unit 10 includes an automatic document feeding device 11 which is called an auto document feeder (ADF) and a document image scanning device 12 (a scanner). The operation display unit 20 is configured as, for example, a liquid crystal display (LCD) of a touch panel unit and serves as a display unit and an operation unit. The image processing unit 30 includes a circuit which performs a digital image process in response to an initial setting or a user setting for the input image data.

The image forming unit 40 includes an image forming unit 41, an intermediate transfer unit 42, and a secondary transfer unit 43 for forming images with color toners of a Y component, an M component, a C component, and a K component on the basis of the input image data.

The image forming unit 41 includes four image forming units 41Y, 41M, 41C, and 41K for the Y component, the M component, the C component, and the K component. Since the image forming units 41Y, 41M, 41C, and 41K have the same configuration, the common elements are indicated by the same reference numerals for the convenience of drawings and description. When the elements need to be separately distinguished, Y, M, C, or K is added to the reference numerals. In FIG. 1, the reference numerals are given only to the elements of the image forming unit 41Y for the Y component and the reference numerals of the elements of the other image forming units 41M, 41C, and 41K are omitted.

The image forming unit 41 includes an exposure device 411, a developing device 412, a photosensitive drum 413, a charging device 414, and a drum cleaning device 415.

The photosensitive drum 413 is, for example, a negatively charged organic photoconductor (OPC) in which an under coat layer (UCL), a charge generation layer (CGL), and a charge transport layer (CTL) are sequentially laminated on a peripheral surface of a conductive cylindrical body (an aluminum pipe) made of aluminum.

The charging device 414 is, for example, a non-contact charging device using Corona discharge. The charging device 414 may be a contact charging device which charges the photosensitive drum 413 in a contact state. The exposure device 411 is configured as, for example, a semiconductor laser. The developing device 412 is a developing device for a two-component developer, and contains a developer of each color component (for example, a two-component developer including a small particle diameter toner and a magnetic material). The drum cleaning device 415 includes a drum cleaning blade such as an elastic blade disposed to slidable on the surface of the photosensitive drum 413.

The intermediate transfer unit 42 includes an intermediate transfer belt 421, a primary transfer roller 422, a plurality of support rollers 423 including a backup roller 423A, and a belt cleaning device 426.

The intermediate transfer belt 421 is configured as an endless belt and is suspended on the plurality of support rollers 423 in a loop shape. At least one of the plurality of support rollers 423 is configured as a driving roller and the others are configured as driven rollers. The belt cleaning device 426 includes a belt cleaning blade such as an elastic blade disposed to slidable on the surface of the intermediate transfer belt 421.

The secondary transfer unit 43 includes, for example, a secondary transfer roller 431. The secondary transfer unit 43 may have a configuration in which a secondary transfer belt is suspended on a plurality of support rollers including the secondary transfer roller in a loop shape.

The fixing unit 60 is disposed as a unit inside a fixing machine F. The fixing unit 60 includes an endless fixing belt 61, two rollers 64 and 65 which support the fixing belt 61 in an endless manner, a heating device 63 which heats the fixing belt 61 supported by the rollers 64 and 65, and a pressing roller 62 which is disposed to be urged toward the roller 64.

The roller 64 is disposed to face the pressing roller 62 with the fixing belt 61 interposed therebetween and the roller diameter is 50 mm or more. The rollers 64 and 65 support the fixing belt 61 on the endless track at a tensile force of 45 N. For example, the roller 64 is a driving roller and the roller 65 is a driven roller. The heating device 63 is configured as, for example, a halogen lamp or a resistance heater and is built in the roller 65. The pressing roller 62 is disposed to move close to and away from the roller 64. When the pressing roller 62 comes into press-contact with the fixing belt 61 supported by the roller 64, the fixing nip portion conveying the sheet S in a sandwiched state is formed. The sheet S corresponds to the recording medium and is, for example, a standard sheet, a special sheet, or the like.

In addition, a heating device of an induction heating (IH) type may be used as the heating device 63. Further, an air separation unit may be further provided inside the fixing machine F to separate the sheet S from the fixing belt 61 or the pressing roller 62 by blowing air thereto. The fixing unit 60 corresponds to the fixing device.

Figure 2A:
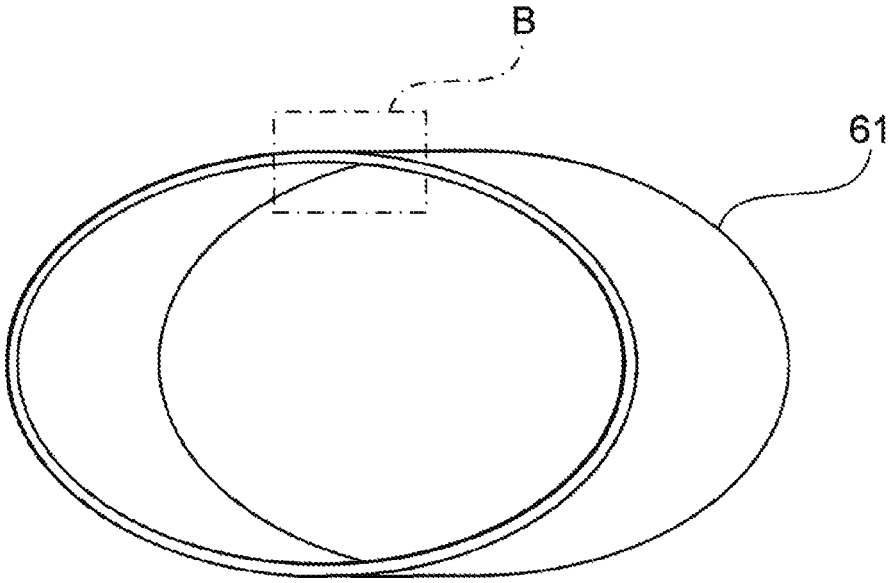
FIG. 2A is a diagram schematically illustrating a configuration of a fixing belt according to an embodiment of the present invention and FIG. 2B is an enlarged view of a part B of FIG. 2A.
Figure 2B:
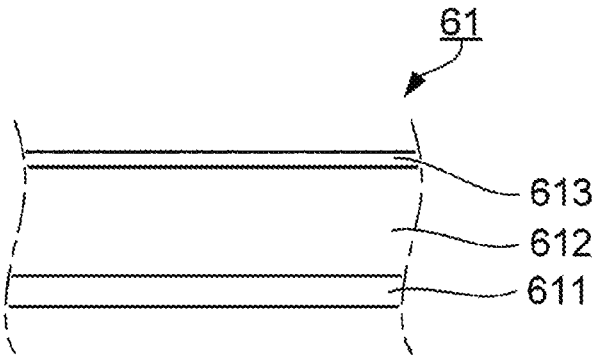

The fixing belt 61 is an endless belt as illustrated in FIG. 2A and has a configuration in which a base layer 611, an elastic layer 612, and a releasing layer 613 are laminated in this order as illustrated in FIG. 2B. The base layer 611 is a polyimide belt, carbon black is dispersed in the base layer 611, and the storage elastic modulus of the base layer 611 is adjusted to 3.8 to 4.8 GPa. The elastic layer 612 is, for example, a layer having elasticity and made of silicone rubber, and the releasing layer 613 is a layer of, for example, perfluoroalkoxy fluororesin (PFA).

The sheet conveying unit 50 includes a sheet feeding portion 51, a sheet discharging portion 52, a first conveying portion 53, and a second conveying portion 57. Three sheet feeding tray units 51*a* to 51*c* constituting the sheet feeding portion 51 respectively receive sheets S identified based on the basis weight, the size, and the like according to a preset type. The first conveying portion 53 includes a plurality of conveying roller portions having an intermediate conveying roller portion 54, a loop roller portion 55, and a registration roller portion 56. The second conveying portion 57 includes a switchback path 58 and a rear surface conveying path 59 where the plurality of conveying roller portions are arranged.

In the image forming apparatus 1, the automatic document feeding device 11 conveys a document D placed on a document tray by a conveying mechanism and delivers the document to the document image scanning device 12. The automatic document feeding device 11 can continuously read images (including both sides) of a large number of documents D placed on the document tray at one time. The document image scanning device 12 optically scans a document placed on a contact glass or a document conveyed onto the contact glass from the automatic document feeding device 11, forms images on a light receiving surface of a CCD (Charge Coupled Device) sensor 12*a* by light reflected from the document, and reads the document images. The image reading unit 10 generates input image data on the basis of a reading result of the document image scanning device 12. The input image data is subjected to a predetermined image process in the image processing unit 30 if necessary.

The control unit 100 controls a driving current supplied to a driving motor (not illustrated) for rotating the photosensitive drum 413. Accordingly, the photosensitive drum 413 rotates at a constant circumferential speed. The charging device 414 uniformly charges the surface of the photosensitive drum 413 to negative polarity. The exposure device 411 irradiates a laser beam corresponding to each color component to the photosensitive drum 413 so that an electrostatic latent image of each color component is formed on the surface of the photosensitive drum 413 due to a potential difference with the periphery. The developing device 412 forms a toner image by visualizing the electrostatic latent image while attaching a toner of each color component to the surface of the photosensitive drum 413.

Meanwhile, the intermediate transfer belt 421 travels at a constant speed in a direction of an arrow A by rotating the support roller 423 serving as a driving roller. When the intermediate transfer belt 421 comes into press-contact with the photosensitive drum 413 by the primary transfer roller 422, a primary transfer nip portion is formed and the toner image of each color on the photosensitive drum 413 is primarily transferred onto the intermediate transfer belt 421 so that the toner images of different colors sequentially overlap. The residual toner remaining on the surface of the photosensitive drum 413 is removed from the surface after the primary transfer by the elastic blade coming into contact with the surface of the photosensitive drum 413 in the drum cleaning device 415.

Meanwhile, when the secondary transfer roller 431 comes into press-contact with the backup roller 423A with the intermediate transfer belt 421 interposed therebetween, a secondary transfer nip portion is formed. The sheet S which is fed from the sheet feeding portion 51 or the second conveying portion 57 is conveyed to the secondary nip transfer portion. The inclination and the position (offset) in the width direction of the sheet S are corrected while being conveyed by the first conveying portion 53.

When the sheet S passes through the secondary transfer nip portion, the toner image carried on the intermediate transfer belt 421 is secondarily transferred onto the sheet S. The sheet S onto which the toner image is transferred is conveyed toward the fixing unit 60. The residual toner remaining on the surface of the intermediate transfer belt 421 after the secondary transfer is removed from the surface by the elastic blade coming into contact with the surface of the intermediate transfer belt 421 in the belt cleaning device 426.

The fixing unit 60 fixes the toner image onto the sheet S by heating and pressing the conveyed sheet S at the fixing nip. The driving control of the fixing belt 61, the pressing roller 62, and the heating device 63 is performed by the control unit 100.

The fixing belt 61 is heated by the heating device 63, so that the fixing belt 61 is uniformly maintained at a predetermined fixing temperature (for example, 170° C.) in the width direction. The fixing temperature is a temperature capable of supplying thermal energy necessary for melting the toner on the sheet S and is different in accordance with the paper type of the sheet S forming an image thereon.

In the case of duplex printing, the second conveying portion 57 first conveys the sheet S to the switchback path 58, switches back the sheet to the rear surface conveying path 59 to reverse the sheet S, and supplies the sheet to the first conveying portion 53 (the upstream side of the loop roller portion 55). Then, the sheet S is supplied to the secondary transfer nip portion again so that a desired toner image is transferred onto the sheet S and then the toner image is fixed onto the sheet S in the fixing unit 60.

In this way, the sheet S having a desired image formed thereon is discharged to the outside of the image forming apparatus 1 by the sheet discharging portion 52 including the sheet discharging roller 52*a*.

The fixing belt 61 has an excellent fixing property of the toner image onto the sheet S and an excellent separation property of the sheet S at the fixing nip portion also in the high-speed image formation. It is considered that the reason is as below.

The fixing belt 61 includes a base layer 611 which has a shape restoring force expressed by a storage elastic modulus of 3.8 to 4.8 GPa and returned to an original shape when being pulled. Then, the fixing belt 61 is sandwiched between the roller 64 and the pressing roller 62 at the fixing nip portion and moves on the endless track to be pulled toward the fixing nip portion. For this reason, the fixing belt 61 is easily bent at the downstream side of the fixing nip portion since the movement speed is slightly lowered.

Figure 3:
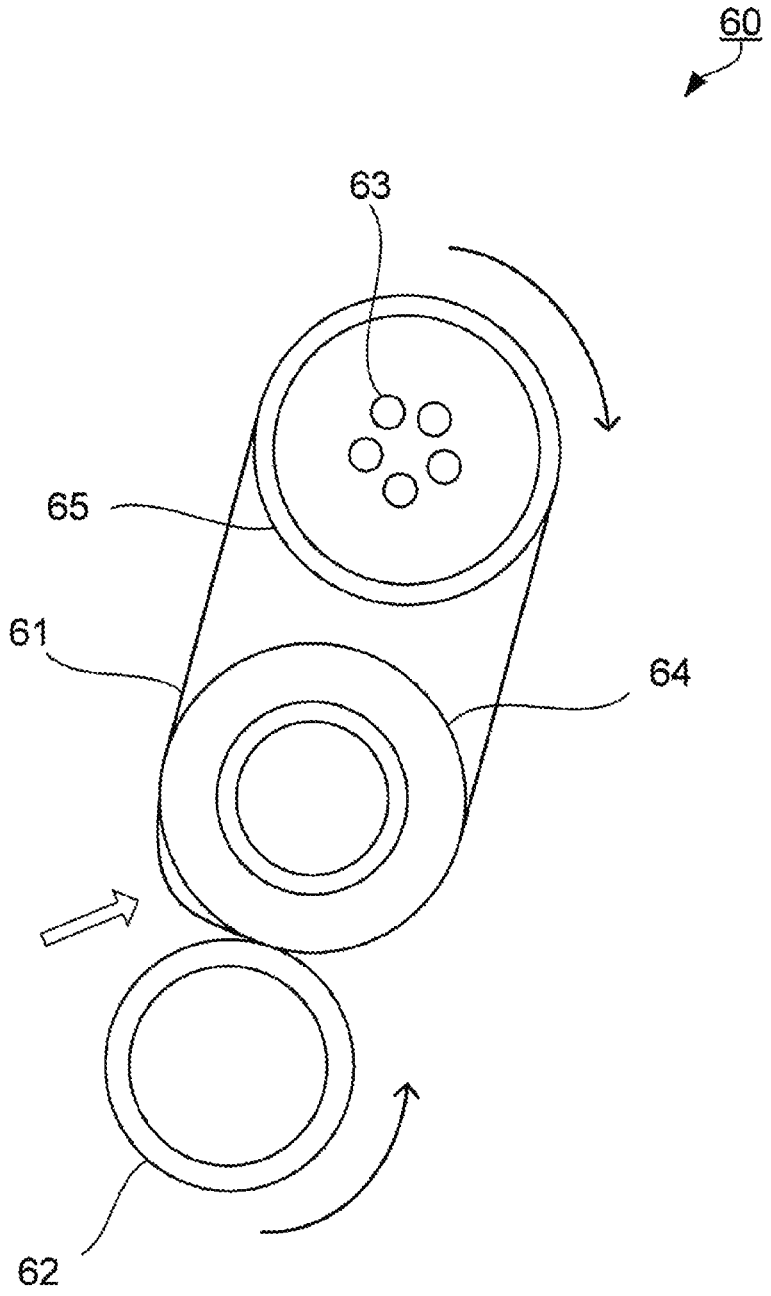
FIG. 3 is a diagram schematically illustrating a fixing nip portion of the fixing belt and a deformation in the vicinity thereof.

Since the base layer 611 of the fixing belt 61 has the above-described restoring force, a deflection having a curvature smaller than the curvature of the fixing belt 61 at the contact portion with respect to the roller 64 is formed at the downstream side of the fixing nip portion as indicated by an outline arrow in FIG. 3. Additionally, in FIG. 3, the deflection is exaggerated.

When the fixing belt 61 is largely bent at the downstream side of the fixing nip portion due to the large storage elastic modulus, the sheet S is easily separated from the fixing belt 61 at the downstream side, but the adhesion of the fixing belt 61 with respect to the sheet S is lowered. When the fixing belt 61 is slightly bent at the downstream side due to the small storage elastic modulus, a change in shape of the fixing belt 61 at the downstream side is small. For this reason, the fixing property is satisfactory, but the separation property improvement effect is small. Since the base layer 611 has the storage elastic modulus within an appropriate range, an appropriate deflection occurs as described above. As a result, the fixing belt 61 is excellent in both the fixing property and the separation property.

As described above, the deflection is formed since the base layer 611 of the fixing belt 61 has an appropriate storage elastic modulus. Further, the fixing nip portion formed when the fixing belt 61 is sandwiched by two rollers (the roller 64 and the pressing roller 62) contributes to the formation of the deflection. Further, a slight difference in the movement speed of the fixing belt 61 between the fixing nip portion and the downstream side thereof also contributes to the formation of the deflection.

Further, when the roller diameter of the roller 64 is small, the deflection is small even when the deflection is formed. Accordingly, it is considered that the roller diameter substantially does not contribute to the improvement in separation property. Thus, a predetermined size or more of the roller diameter of the roller 64 disposed to face the pressing roller 62 also contributes to the formation of the deflection.

It is considered that an effect in which both the fixing property and the separation property are excellent in the image forming apparatus or the image forming method can be further adjusted by the adjustment of the factors other than the storage elastic modulus of the fixing belt 61 among the factors causing the deflection.

The deflection is continuously formed while the fixing nip portion is formed and the fixing belt 61 is deformed as described above whenever the fixing nip portion is formed. Thus, it is preferable that the fixing belt 61 has sufficient toughness which allows easy bending, but prevents easy breakage from the viewpoint of durability. From such a viewpoint, the fixing belt 61 preferably has the bending strength of 5000 times or more.

Further, in the image forming method having a condition without the deflection, the effect of improving the transferability by the elastic layer and the effect of improving the separation property by the releasing layer can be sufficiently exhibited by the fixing belt 61. Thus, the image forming apparatus 1 can form a satisfactory image even in the image formation at a speed lower than the high speed.

As apparent from the description above, the fixing belt of the embodiment includes the base layer having heat resistance, the elastic layer made of an elastic material and disposed on the base layer, and the releasing layer disposed on the elastic layer and the storage elastic modulus of the base layer is 3.8 to 4.8 GPa. Further, the fixing device of the embodiment includes the endless fixing belt, two or more rollers supporting the fixing belt in an endless manner, the heating device heating the fixing belt supported by the rollers, and the pressing roller disposed to be urged toward one roller of the two or more rollers and the roller diameter of the roller urged by the pressing roller with the fixing belt interposed therebetween is 50 mm or more. Further, the image forming apparatus of the embodiment is of an electrophotographic system and includes the fixing device fixing the unfixed toner image carried on the recording medium onto the recording medium by heating and pressing. Thus, it is possible to realize a fixing operation which is excellent in both the fixing of the toner image and the separation of the recording medium at the time of fixing the toner image in the electrophotographic image formation.

It is more effective that the storage elastic modulus of the base layer is 4.0 to 4.5 GPa from the viewpoint of improving both the fixing property and the separation property.

Further, it is more effective that the bending strength of the base layer is 5000 times or more from the viewpoint of the durability of the fixing belt and the viewpoint of exhibiting the fixing property and the separation property for a long period of time.

Further, it is more effective that the base layer is made of heat-resistant resin from the viewpoint of the durability of the member, it is more effective that the heat-resistant resin is polyimide, the elastic material is silicone rubber, and the material of the releasing layer is fluororesin from the viewpoint of the image fixing stability, and it is more effective that the fluororesin is perfluoroalkoxy fluororesin from the viewpoint of the image separation property.

Further, it is more effective that the fixing belt is supported by the two or more rollers at the tensile force of 45 N or less from the viewpoint of both improvements in the fixing property and the separation property.

EXAMPLES

The present invention will be described in more detail with reference to the examples and comparative examples below. In addition, the present invention is not limited to the examples below.

Example 1

A varnish containing polyamic acid and 8% of carbon black by mass with respect thereto was spin-coated on an outer surface of a cylindrical mold, was dried at 300 to 450° C., and was imidized to obtain a cylindrical polyimide tubular article (base belt) having an inner diameter of 99 mm, a length of 360 mm, and a thickness of 70 μm. The polyamic acid is a polymer obtained by dehydration condensation of 3,3',4,4'-biphenyltetracarboxylic dianhydride and p-phenylenediamine.

The tensile strength $S_T$, the bending strength $S_F$, and the storage elastic modulus G' of the base belt were obtained. Thus, the tensile strength $S_T$ was 310 MPa, the bending strength $S_F$ was 6300 times, and the storage elastic modulus G' was 4.8 GPa. The tensile strength $S_T$ of the base belt was measured by the tensilon universal tensile tester (manufactured by A&D Co., Ltd.). The bending strength $S_F$ of the base belt was measured by the bending endurance-MIT test. The storage elastic modulus G' of the base belt was measured by the dynamic viscoelasticity measurement (DMA) in a tensile mode.

Next, a cylindrical metal core made of stainless steel and having an outer diameter of 99 mm was closely adhered to the inside of the base belt and a cylindrical metal mold for holding a PFA tube having a thickness of 30 μm on the inner peripheral surface was provided on the outer surface of the base belt. In this way, the metal core and the cylindrical metal mold were held coaxially and a cavity was formed between them. Next, a silicone rubber material was injected into the cavity and was heated and cured to manufacture an elastic layer of silicone rubber having a thickness of 200 μm. In this way, the base layer made of the base belt, the elastic layer made of the silicone rubber, and the releasing layer made of PFA were laminated in this order to obtain the endless fixing belt 61.

The rubber hardness (type A) of the silicone rubber is 30°, the tensile strength is 1.5 MPa, the thermal conductivity is 0.7 W/(m·K), and the elongation is 250%.

The rubber hardness of the silicone rubber is measured by a durometer A in accordance with JIS K 6301 using a rubber sheet for measurement having a thickness of 10.0 mm. The rubber sheet is manufactured under the same conditions as the elastic layer manufacturing conditions.

The tensile strength of the silicone rubber is measured by the tensilon universal tensile tester (manufactured by A&D Co., Ltd.) using the rubber sheet similarly to the base belt. The elongation of the silicone rubber was measured by the tensilon universal tensile tester (manufactured by A&D Co., Ltd.) using the rubber sheet. The thermal conductivity of the silicone rubber is measured by a QTM rapid thermal conductivity meter (manufactured by Kyoto Electronics Industry Co., Ltd.) using the rubber sheet.

Examples 2 to 5 and Comparative Examples 1 and 2

The fixing belts 2 to 5 were respectively obtained similarly to Example 1 except that the content of carbon black in the varnish was changed to 9, 11, 14 and 15% by mass. Further, the fixing belts C1 and C2 were respectively obtained similarly to Example 1 except that the content of carbon black in the varnish was changed to 5 and 18% by mass.

In the fixing belt 2, the tensile strength $S_T$ of the base belt was 302 MPa, the push bending strength $S_F$ was 6000 times, and the storage elastic modulus G' was 4.5 GPa. In the fixing belt 3, the tensile strength $S_T$ of the base belt was 295 MPa, the push bending strength $S_F$ was 5800 times, and the storage elastic modulus G' was 4.0 GPa. In the fixing belt 4, the tensile strength $S_T$ of the base belt was 290 MPa, the push bending strength $S_F$ was 5700 times, and the storage elastic modulus G' was 3.8 GPa. In the fixing belt 5, the tensile strength $S_T$ of the base belt was 300 MPa, the push bending strength $S_F$ was 4000, and the storage elastic modulus G' was 3.8 GPa. In the fixing belt C1, the tensile strength $S_T$ of the base belt was 330 MPa, the push bending strength $S_F$ was 20000 times, and the storage elastic modulus G' was 4.9 GPa. Then, in the fixing belt C2, the tensile strength $S_T$ of the base belt was 260 MPa, the push bending strength $S_F$ was 200 times, and the storage elastic modulus G' was 3.7 GPa.

[Evaluation]

The fixing belts 1 to 5, C1, and C2 are provided as the fixing belt of the electrophotographic image forming apparatus including the two-axis belt type fixing device illustrated in FIG. 1. The roller diameter of the roller forming the fixing nip portion and supporting the fixing belt (disposed to face the pressing roller) is 60 mm. In each of the fixing belts, the surface temperature of the fixing belt was set to 180° C., a toner image having a magenta belt-shaped solid image with a width of 5 cm was transferred onto an A4 size plain sheet in a direction perpendicular to the conveying direction of the plain sheet (toner adhesion amount: 8 g/m$^2$), and the plain sheet was passed through the fixing nip portion in the longitudinal direction at a speed of 60 sheets/minute to form a fixed image of the belt-shaped image on the plain sheet.

(1) Separation Property

The separation property between each fixing belt and the plain sheet at the time of fixing the belt-shaped image is evaluated according to the following standard.

⊙: Separation of plain sheet without curl

○: Level without critical problem despite slight curl of plain sheet

Δ: Wrinkle of plain sheet

×: Non-separation of plain sheet (jam of passing sheet)

(2) Fixing Property

The fixing property is evaluated according to the following standard by visually observing the belt-shaped image. In addition, an image defect due to a fixing failure is an image defect (roughness in appearance) due to a cold offset or an image defect (occurrence of jam of passing sheet) due to a hot offset.

○: No defect due to fixing failure of solid image

Δ: Level without critical problem despite fine fixing defect

×: Defect due to fixing defect of solid image

The physical properties and the evaluation results of the fixing belts 1 to 5, C1, and C2 are illustrated in Table 1.

TABLE 1

| | FIXING BELT | | | | SEPARATION | FIXING |
|---|---|---|---|---|---|---|
| | No. | $S_T$ (MPa) | $S_F$ (TIMES) | G' (GPa) | PROPERTY | PROPERTY |
| EXAMPLE 1 | 1 | 310 | 6300 | 4.8 | ⊙ | Δ |
| EXAMPLE 2 | 2 | 302 | 6000 | 4.5 | ⊙ | ○ |
| EXAMPLE 3 | 3 | 295 | 5800 | 4.0 | ⊙ | ○ |
| EXAMPLE 4 | 4 | 290 | 5700 | 3.8 | ○ | ○ |
| EXAMPLE 5 | 5 | 300 | 4000 | 3.8 | Δ | ○ |
| COMPARATIVE EXAMPLE 1 | C1 | 330 | 20000 | 4.9 | ⊙ | X |
| COMPARATIVE EXAMPLE 2 | C2 | 260 | 200 | 3.7 | X | ○ |

As apparent from Table 1, all the fixing belts 1 to 5 have sufficient performance in the fixing property and the separation property of the high-speed image forming apparatus using the two-axis belt type fixing device. Thus, it is understood that the separation property and the fixing property are simultaneously obtained in that the storage elastic modulus G' of the base layer of the fixing belt is 3.8 to 4.8 GPa.

Further, all the fixing belts 1 to 5 have high bending strengths $S_F$. However, among them, $S_F$ is preferably 5000 times or more and more preferably 5800 times or more from the viewpoint of improving the separation property.

On the contrary, the fixing belt C1 did not have a sufficient fixing property and the fixing belt C2 did not have a sufficient separation property. Regarding the fixing belt C1, this is because G' of the base layer is large and the deformation of the fixing nip portion and the downstream side thereof is too large. Regarding the fixing belt C2, G' of the base layer is small and the separation property improvement effect due to the above-described deformation is not sufficient.

According to an embodiment of the present invention, it is possible to improve both the fixing property of the fixing belt and the separation property of the fixing belt with respect to the recording medium in the electrophotographic image formation in the high-speed machine having the two-axis belt type fixing device. Thus, according to an embodiment of the present invention, the faster speed, the higher performance, and the more labor saving in the electrophotographic image forming apparatus are expected, and the further spread of the image forming apparatus is expected.

Although embodiments of the present invention have been described and illustrated in detail, it is clearly understood that the same is by way of illustration and example only and not limitation, the scope of the present invention should be interpreted by terms of the appended claims.

What is claimed is:

1. A fixing belt comprising:

a base layer having heat resistance;

an elastic layer disposed on the base layer and made of an elastic material; and a releasing layer disposed on the elastic layer, wherein a storage elastic modulus of the base layer is 3.8 to 4.8 GPa, the storage elastic modulus being a shear storage modulus of the base layer.

2. The fixing belt according to claim 1, wherein a storage elastic modulus of the base layer is 4.0 to 4.5 GPa.

3. The fixing belt according to claim 1, wherein a bending strength of the base layer is 5000 times or more.

4. The fixing belt according to claim 1, the base layer is made of heat-resistant resin.

5. The fixing belt according to claim 4, wherein the heat-resistant resin is polyimide.

6. The fixing belt according to claim 1, wherein the elastic material is silicone rubber and a material of the releasing layer is fluororesin.

7. The fixing belt according to claim 6, wherein the fluororesin is a perfluoroalkoxy fluororesin.

8. A fixing device comprising:

an endless fixing belt;

two or more rollers that supports the fixing belt in an endless manner;

a heating device that heats the fixing belt supported by the rollers; and a pressing roller disposed to be urged toward one roller among the two or more rollers, wherein a roller diameter of the roller urged by the pressing roller with the fixing belt interposed therebetween is 50 mm or more, and wherein the fixing belt is the fixing belt according to claim 1.

9. The fixing device according to claim 8, wherein the fixing belt is supported by the two or more rollers at a tensile force of 45 N or less.

10. An electrophotographic image forming apparatus comprising:

a fixing device that fixes an unfixed toner image carried on a recording medium onto the recording medium by heating and pressing, wherein the fixing device is the fixing device according to claim 8.

* * * * *